US005951181A

United States Patent [19]

Hierro et al.

[11] Patent Number: 5,951,181

[45] Date of Patent: Sep. 14, 1999

[54] SPACED-APART DEFLECTOR STRUCTURE FOR ALLOWING MANUAL INSERTION CONTROL OF BOTH SHEET AND ROLLFEED MEDIA

[75] Inventors: Lluis Hierro; David Claramunt; Antonio Hinojosa, all of Barcelona, Spain

[73] Assignee: Hewlett-Packard Company, Palo Alto, Calif.

[21] Appl. No.: 08/922,230

[22] Filed: Sep. 2, 1997

[51] Int. Cl.[6] ..... B41J 13/10

[52] U.S. Cl. ..... 400/645; 400/642; 271/264

[58] Field of Search ..... 400/642, 645, 400/645.3, 647, 647.1, 599, 600, 601, 607, 600.1, 595–598; 271/314, 264, 275

[56] References Cited

U.S. PATENT DOCUMENTS

| | | | |
|---|---|---|---|
| 4,326,815 | 4/1982 | Kapp | 400/625 |
| 4,674,735 | 6/1987 | Dubois et al. | 271/10 |
| 5,035,413 | 7/1991 | Yamada et al. | 271/9 |
| 5,255,989 | 10/1993 | Berthold et al. | 400/605 |
| 5,393,151 | 2/1995 | Martin et al. | 400/642 |
| 5,456,544 | 10/1995 | Aoki et al. | 400/642 |
| 5,595,380 | 1/1997 | McCue, Jr. et al. | 271/9.09 |

*Primary Examiner*—Edgar Burr
*Assistant Examiner*—Dave A. Ghatt
*Attorney, Agent, or Firm*—David S. Romney

[57] ABSTRACT

A plurality of spaced-apart deflector guides are positioned over the input platen of a printer. They are suspended from an elongated media shield which extends laterally across an input media path such that a leading edge of media can easily fit under both the media shield and deflector guides. Each deflector guide has a plurality of downward facing surfaces such as ribs for directing the media toward an input slot defined by a top surface of the input platen, a terminal edge of the deflector guides, and a terminal edge of the media shield. The spaces between the deflector guides are wide enough to allow both hands to be placed directly on the media adjacent to or between two deflector guides for easy manual manipulation of a leading edge of the media into general alignment with the input slot where it can be gripped between the main pick roller and opposing pinch wheels for feeding into a print zone on the printer. The invention is applicable to both sheet feed and rollfeed printer devices.

13 Claims, 7 Drawing Sheets

SPACED-APART DEFLECTOR STRUCTURE FOR ALLOWING MANUAL INSERTION CONTROL OF BOTH SHEET AND ROLLFEED MEDIA

BACKGROUND OF THE INVENTION

Small desktop printers have provided high speed reliable pick mechanisms for feeding office size sheet media into a media path leading to a print zone. But large format printers of D and E size have typically required cumbersome and slow initialization procedures for feeding a leading edge of media all the way past the print zone, and then performing various steps of re-alignment. Accordingly, it is an object of the invention to redesign the entry path for incoming sheet and rollfeed media in order to simplify and make more reliable the feeding of a leading edge of media into engagement with a pick-roller on the printer.

BRIEF SUMMARY OF THE INVENTION

A plurality of spaced-apart deflector guides are positioned over the input platen of a printer. They are suspended from an elongated media shield which extends laterally across an input media path such that a leading edge of media can easily fit under both the media shield and deflector guides. Each deflector guide has a plurality of downwardly facing surfaces such as ribs for directing the media toward an input slot defined by a top surface of the input platen, a terminal edge of the deflector guides, and a terminal edge of the media shield. The spaces adjacent to and between the deflector guides are wide enough to allow both hands to be placed directly on the media adjacent to or between the deflector guides for easy manual manipulation of a leading edge of the media into general alignment with the input slot where it can be gripped between the main pick roller and opposing pinch wheels for feeding into a print zone on the printer. The invention is applicable to both sheet feed and rollfeed printer devices.

DETAILED DESCRIPTION OF PREFERRED EMBODIMENT

Figure 1:
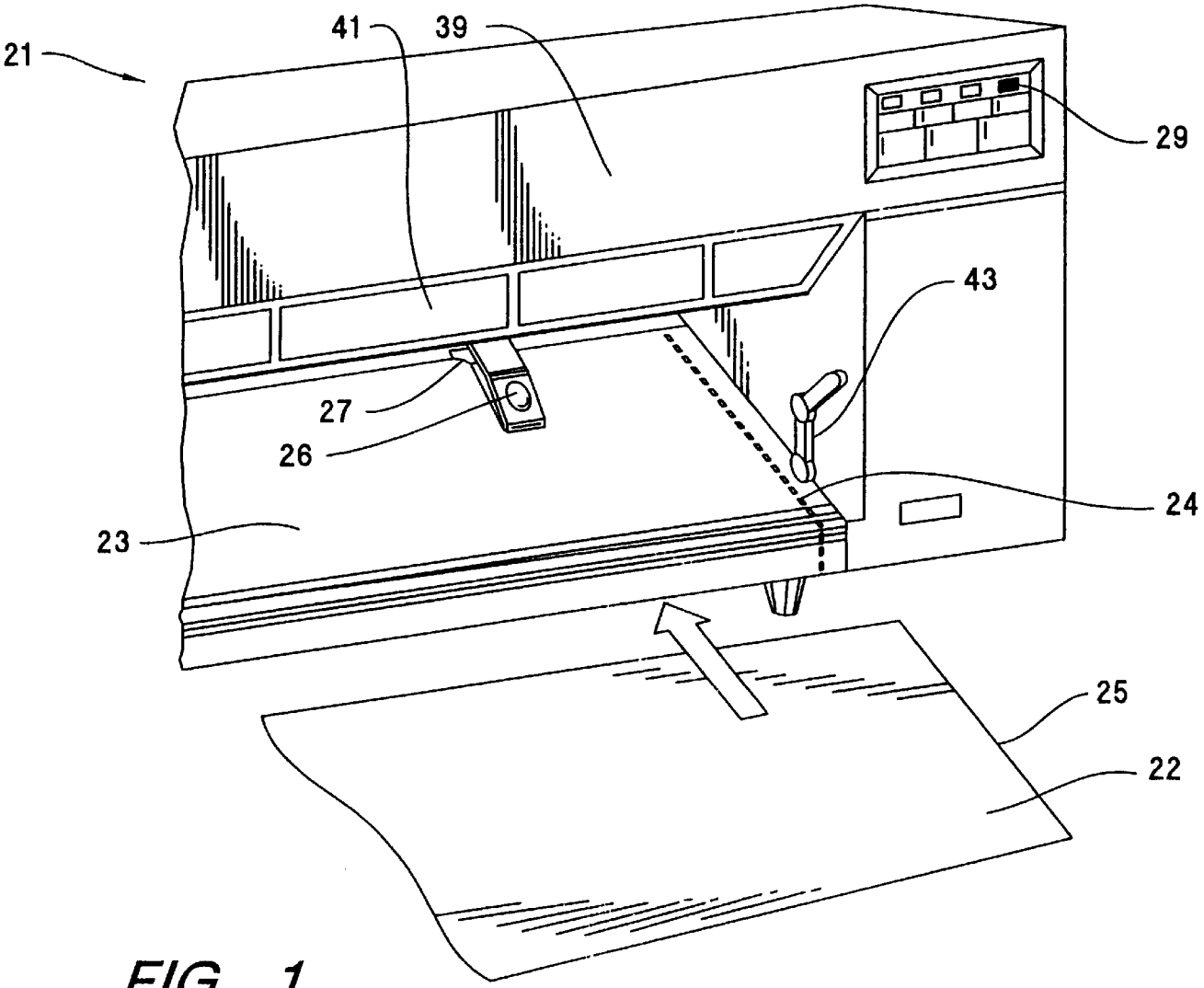
FIG. 1 is a fragmented pictorial view showing a printer which incorporates the present invention with an active deflector guide.

Referring now to FIGS. 1–4 in the drawings, the invention is applicable to a printer such as a large format inkjet printer 21 into which printing media such as sheet 22 may be fed along a media path leading to a print zone (not shown). A front input platen 23 for the printing media has on one side an alignment of reference marks 24 which may be formed by small holes, for enabling a corresponding side edge 25 of the printing media to be aligned at the moment when it is introduced into the front portion of the printer. The manual feeding operation for loading the printing media into the machine therefore involves the alignment of the edge 25 with the reference line (See FIG. 2). As part of the media feeding procedures, the operator must ensure that a front leading edge of the printing media is suitably positioned without substantial deviation. This entire operation takes place with the printing-media entrainment rollers (typically a pick-roller and opposing pinch rollers) stationary to allow the operator to manipulate the printing media properly as it enters the machine. Only when the operator has ensured that the printing media is suitably positioned at the input of the machine does he operate a control button such as push-button 26 for activating the drive motor (not shown) of the printing media entrainment rollers. In the embodiment whown in the drawings, the push-button 26 is incorporated in an active deflector guide 27 which acts as a deflector for both the input and output of the printing media. This arrangement considerably facilitates the manual operation of the activation push-button. However, the push-button may be disposed in any other position on the machine, for example, on the instrument panel 29 or in another suitable place, as appropriate for the general configuration of the machine or for the way in which it operates.

Figure 2:
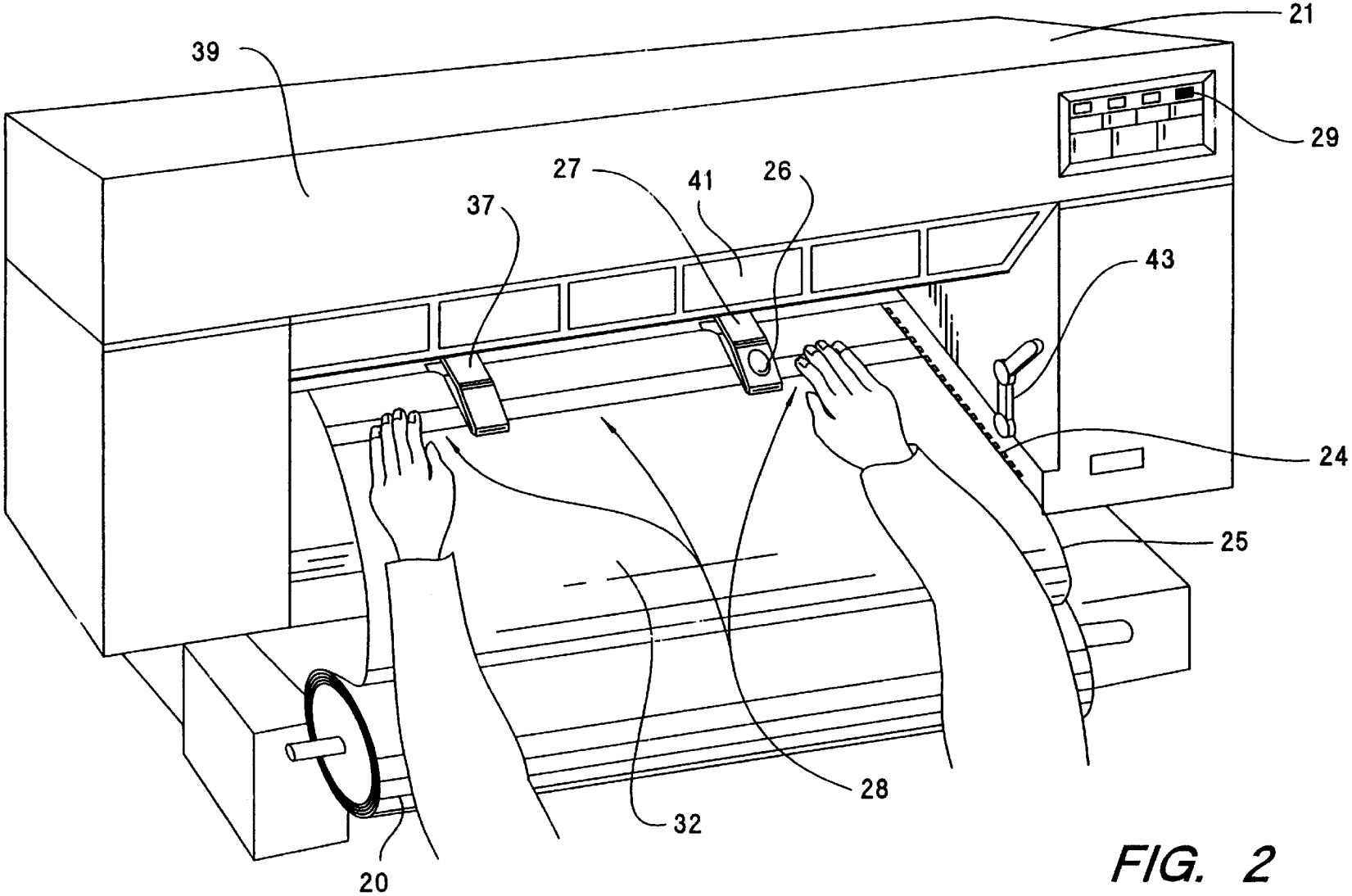
FIG. 2 shows a front pictorial view of a rollfeed printer which incorporates the present invention, with a user manually feeding a leading edge of rollfeed media past two deflector guides.
Figure 3:
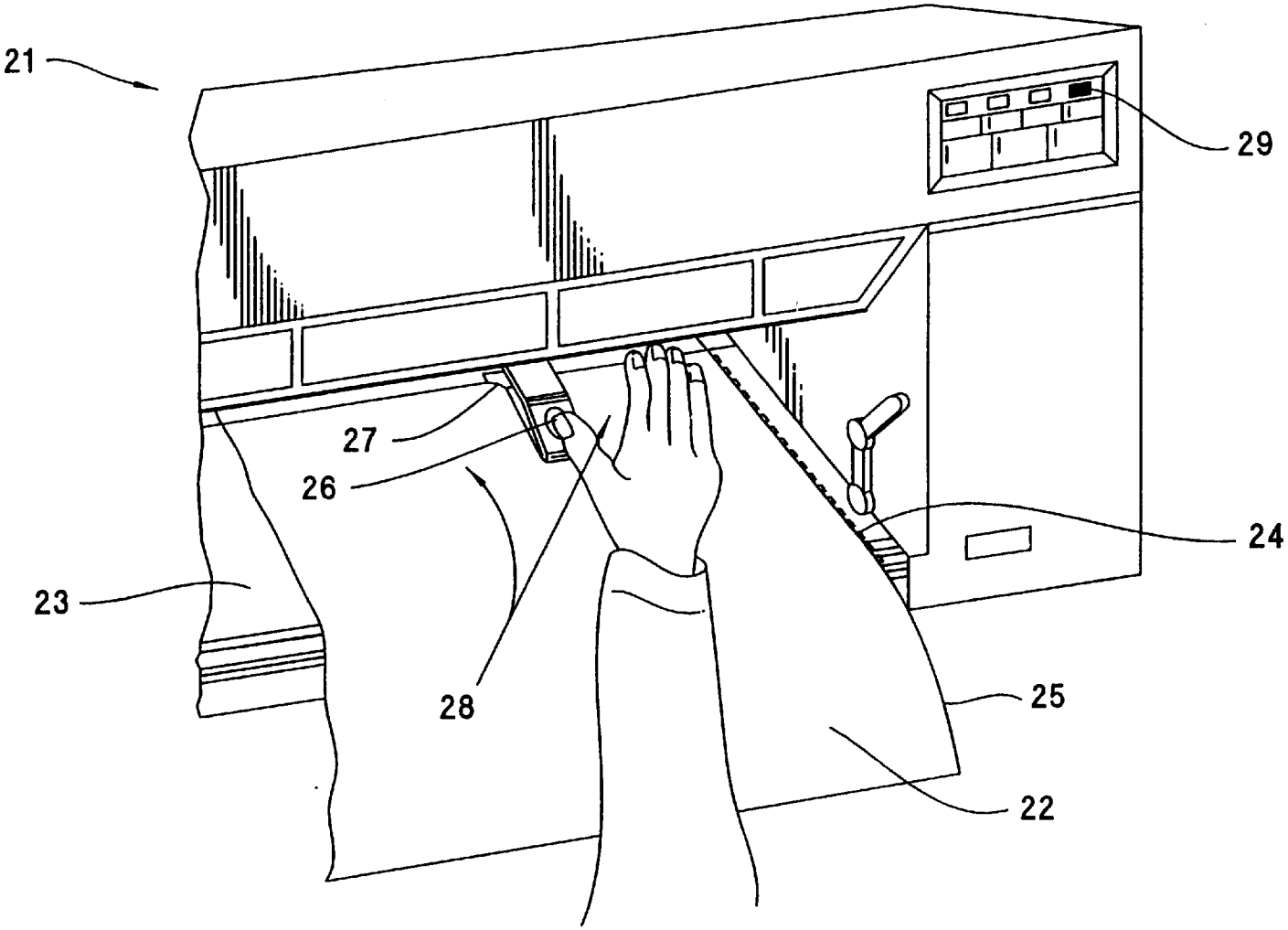
FIG. 3 shows the pictorial view of FIG. 1 with a leading edge of media in position for being pulled into a media path, upon activation of a control button on an active deflector guide by a user without having to remove the right hand from holding the media against an input platen.
Figure 4:
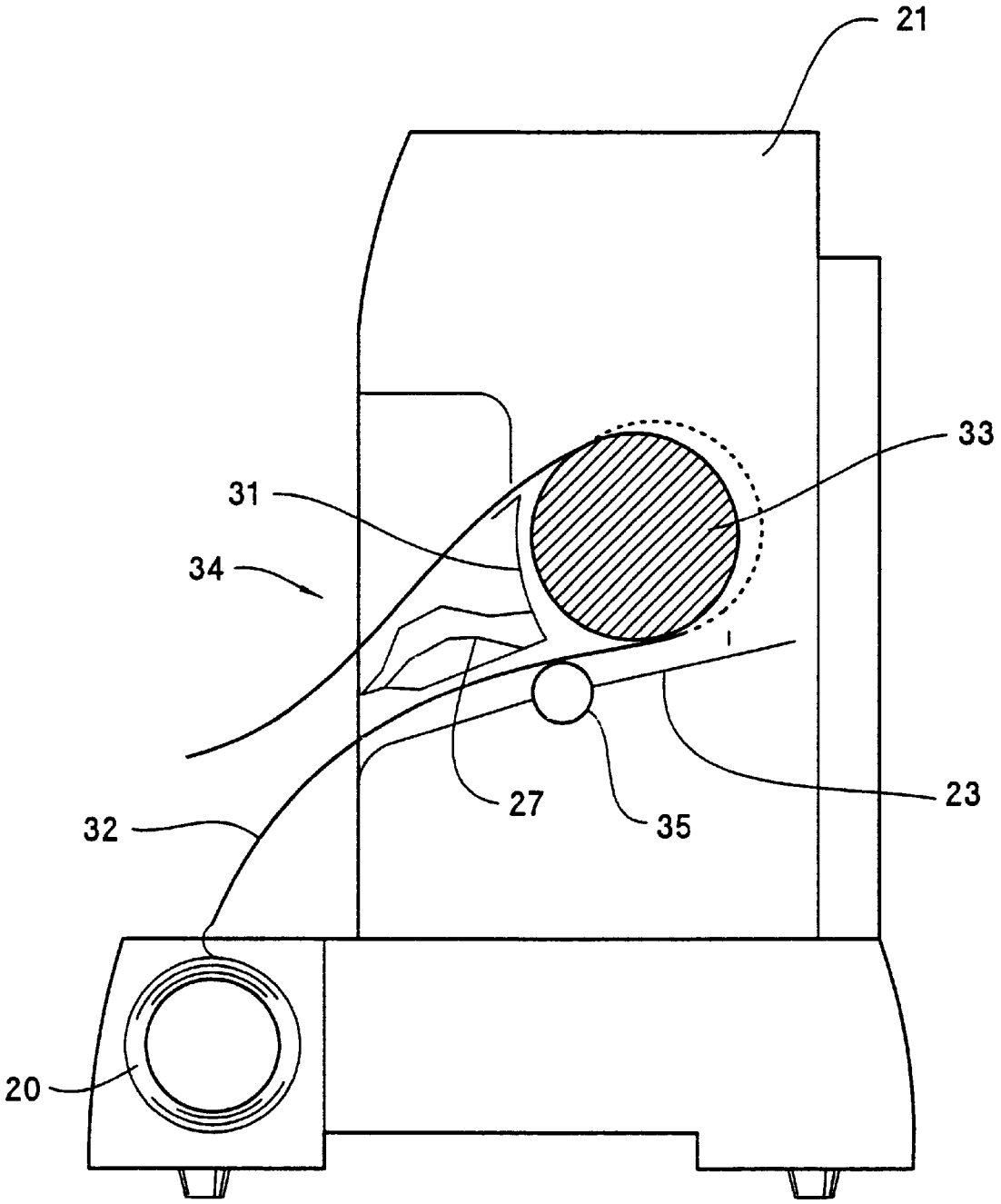
FIG. 4 is a schematic view partially in cross-section showing a media path for passing rollfeed media through the printer of FIGS. 1–3.

As can be seen from FIGS. 2 and 4, the rollfeed printing media 32 can proceed from a roll 20 past a deflector guide 27 and media shield 31 along an input platen 23 to an entry slot between a main pick roller 33 and pinch wheel 35 for passing the media past a print zone (not shown) to an output path 34. The space 28 between or adjacent to the deflector guides (active 27 and passive 37) is available for placing one or both hands directly on top of the media to guide its leading edge up to the input slot. Even when the printer top 39 is closed, it is still possible see the media through a transparent window 41 on the front of the printer top. Also, one of the manual access spaces 28 on the right side of the input platen is very close to a pinch wheel release lever 43 for moving the pinch wheels between an engagement and disengagement position.

Figure 6A:
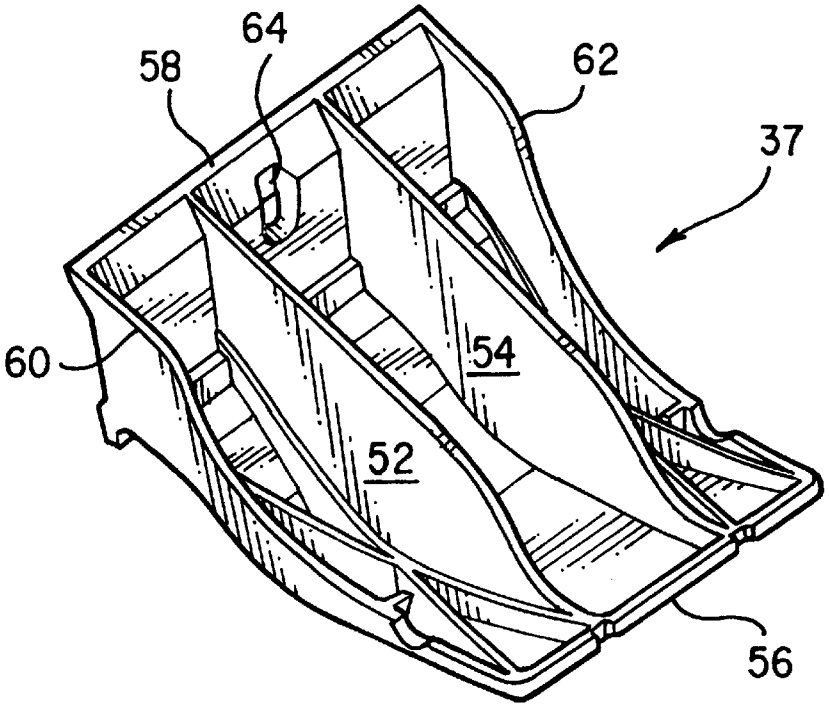
FIG. 6A is an isometric view showing a bottom portion of a passive deflector guide with a plurality of ribs for guiding media along the input platen.
Figure 5:
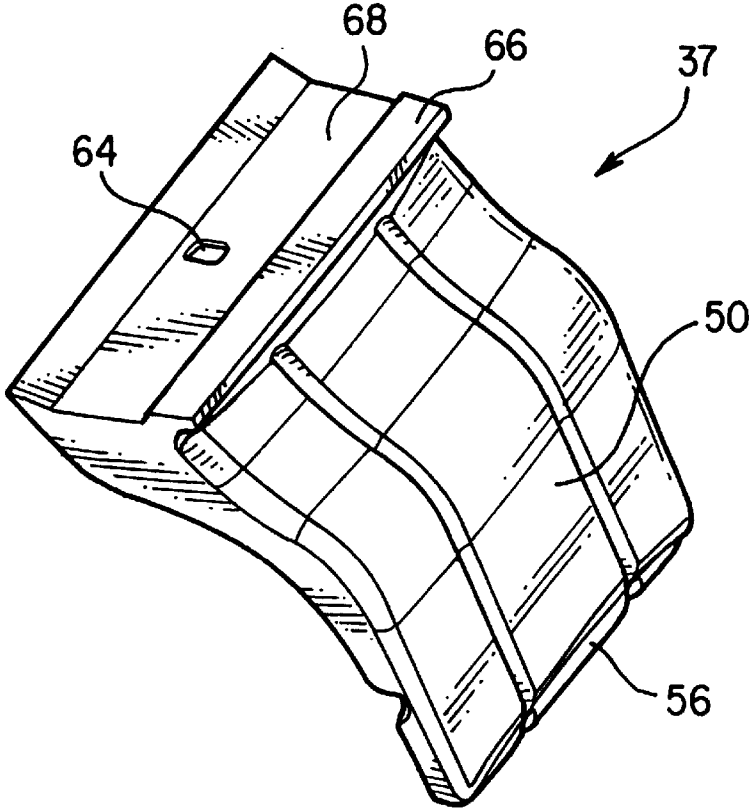
FIG. 5 is an isometric view showing a top portion of a passive deflector guide, as well as its forward end for engagement with a media shield of the printer.

FIGS. 5 and 6A show the details of a passive deflector guide 37 which has no active elements. A top surface 50 acts as a media output guide, while an underside portion provides various guide surfaces for a leading edge of incoming media, including two interior ribs 52, 54 which extend the full distance from a front edge 56 to a rear edge 58, and two truncated exterior ribs 60, 62 which only contact the media during its final approach to an input slot near the main roller 33 and pinch rollers 35. All of the four ribs terminate at the bottom rear edge 58 which extends the full width across the deflector guide. An aperture 64 is provided for a screw attachment to the media shield at spaced apart positions across the media path. The positions are chosen to be displaced from the side boundaries of the media path, and also to avoid having an edge of standard-sized media (A, B, C, D and E sizes) be located under one of the deflector guides. This facilitates the ability to manually guide the leading edge of media with one or both hands while at the same time the aforementioned ribs and edges of the deflector guide feed the leading edge toward the input slot near the pick roller. A top flange 66 extends along a top rear edge for sliding engagement with a matching slot in the media shield. The rest of the forward front facing 68 is sized and contoured to abut against a matching surface 69 on the media shield.

Figure 6B:
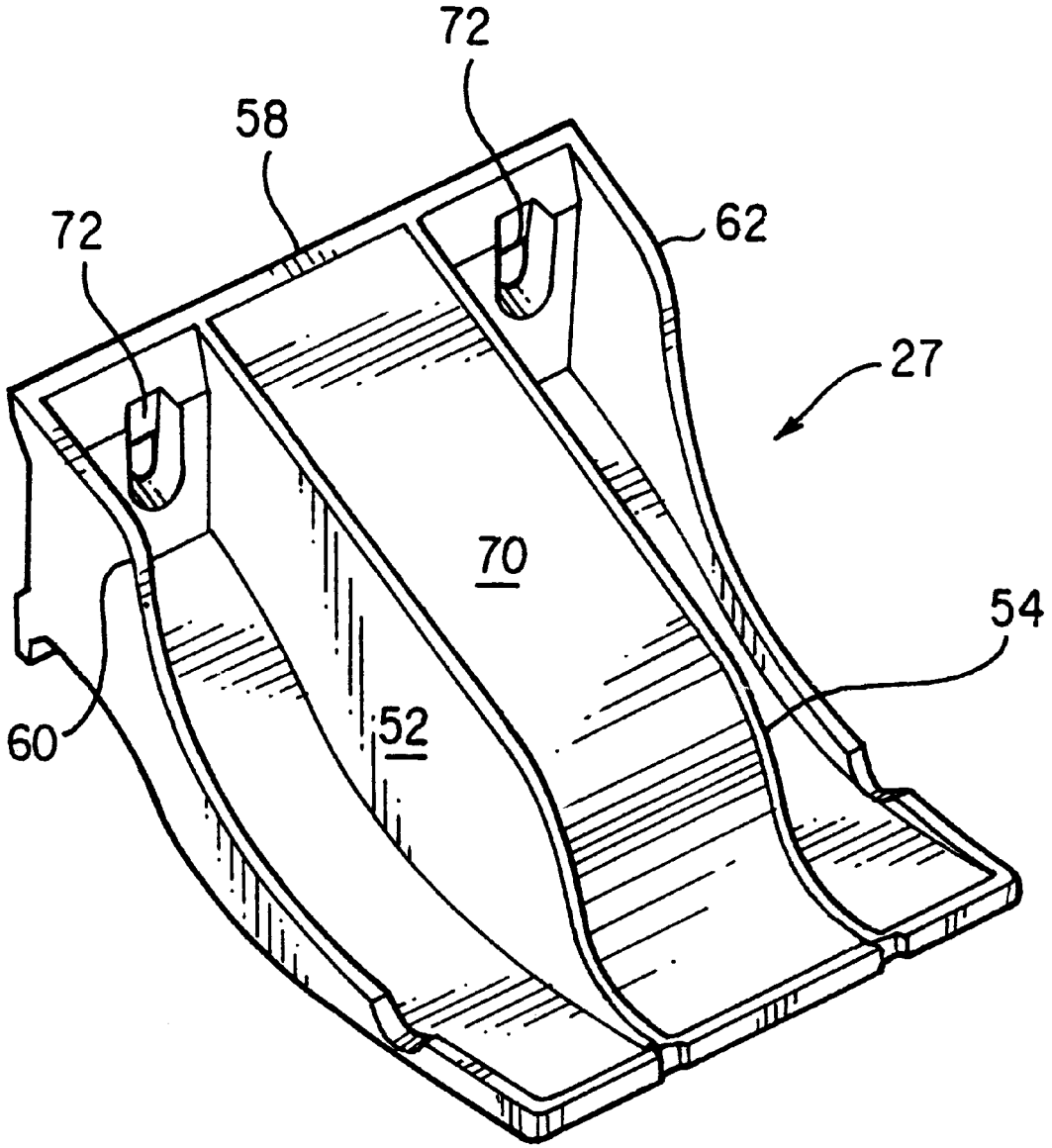
FIG. 6B is an isometric view showing a bottom portion of an active deflector guide with a pair of peripheral ribs and a central downwardly facing surface for guiding media along the input platen.

When the deflector guide is an active one 27 such as shown in FIG. 6B, the interior ribs have a wall 70 extending therebetween to cover and protect any active components such as an electric button, optical media sensor, etc. as well as to present a downwardly facing surface to further direct a leading edge of media along its desirable media path. Therefore screw apertures 72 are provided outside of the center enclosed section for attachment to the media shield.

Figure 8:
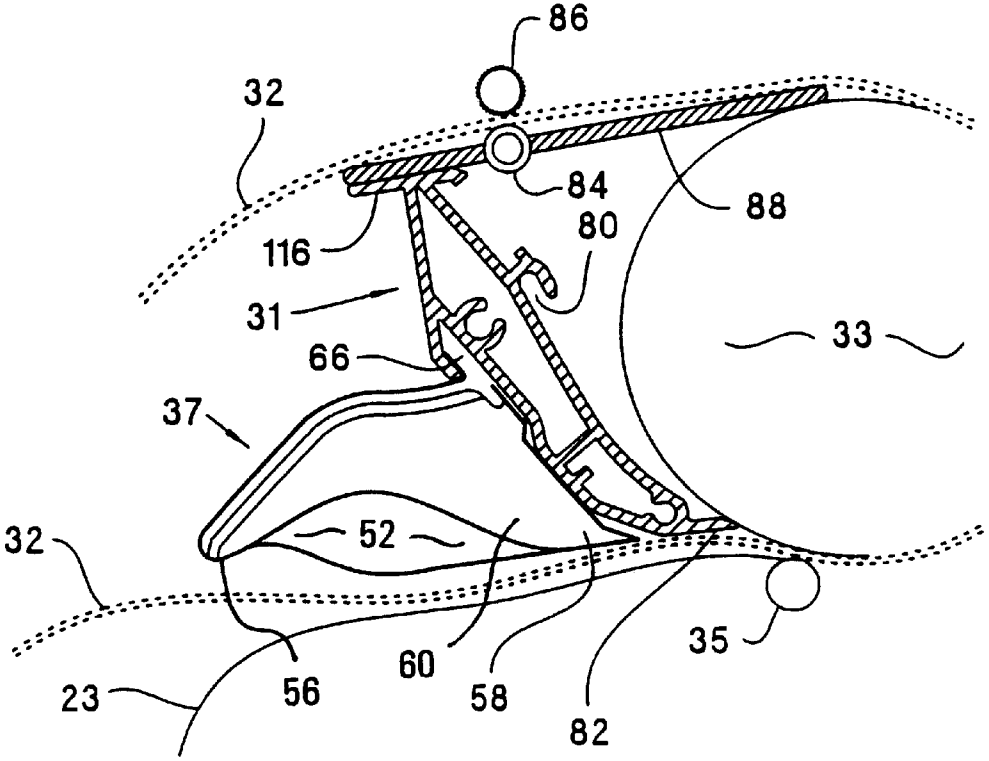
FIG. 8 is a partially sectional view showing the input and output paths for media passing through the printer.
Figure 7:
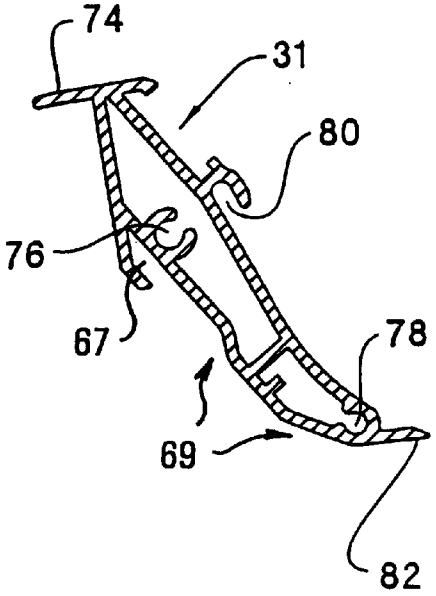
FIG. 7 is a right end view of the media shield.

FIGS. 7–8 show the details of the media shield 31, including an output platen 74, central and bottom mounting screw holes 76, 78, rear mounting slot 80 for hanging on night and left printer frame pins (not shown), and input slot guide 82 which aligns with rear edge 58 to provide a continuous guide into the pinch wheels 35/pick rollers 33 portion of the media path. The output path may include output rollers 84, star wheels 86, and a flexible mylar paper separator 88.

It will therefore be appreciated by those skilled in the art that a unique method and apparatus which facilitates the manual feeding of all sizes (standard as well as oversize and custom size) of both sheet and rollfeed media over an input plate by providing spaced apart deflector guides as well as manually accessible spaces for using manual control of media easily visible through a viewing window, and in some instances a push-button control as well as pinch wheel lever controls can be position adjacent to such manually accessible spaces, all within the spirit and scope of the following claims.

We claim as our invention:

1. A printer for passing media along a media path to a print zone, comprising:

a media path defined by an entry platen leading to a pick-roller;

one or more deflection guides mounted on the printer in a position over the entry platen having sufficient space on both sides of said guide for manually holding and manipulating media to feed a leading edge thereof along the media path toward the pick-roller, said one or more deflection guides including downwardly facing surfaces for directly contacting an upper surface of the media without stopping the forward movement of the media's leading edge; and a media shield extending at least partially across the media path, said media shield attachable to said deflection guide in order to suspend said deflection guide over the media path.

2. The printer of claim 1 which includes at least two of said deflection guides.

3. The printer of claim 1 wherein said media shield includes a lower edge in close proximity to the pick roller.

4. The printer of claim 3 wherein said deflection guide includes a series of ribs having downwardly facing surfaces which extend along the media path to terminate near said lower edge of said media shield.

5. The printer of claim 1 wherein said one or more deflection guides include an upwardly facing portion defining a media output path.

6. The printer of claim 1 which further includes a manually activated on/off control operatively connected to the pick roller.

7. The printer of claim 6 wherein said on/off control is located on one of said deflection guides.

8. The printer of claim 6 wherein said on/off control is capable of being manually activated to be turned on after said leading edge of the media has been manually fed past the entry platen.

9. The printer of claim 1 wherein said media path is further defined by side boundaries, and wherein said one or more deflection guides are displaced from said side boundaries.

10. The printer of claim 9 which includes at least two of said deflection guides displaced from said side boundaries and spaced apart from each other.

11. The printer of claim 10 wherein said at least two of said deflection guides include upwardly facing portions defining a media output path.

12. The printer of claim 1 which further includes a pinch wheel on the printer adjacent to said pick-roller for holding media against said pick roller; and a manually actuated lever on the printer coupled to said pinch wheel to move said pinch wheel between an engagement position and a disengagement position.

13. The printer of claim 1 which includes an entry platen for receiving both sheet media and rollfeed media.

* * * * *